US005413216A

United States Patent [19]

Timmins

[11] Patent Number: 5,413,216

[45] Date of Patent: May 9, 1995

[54] SHIPPING RACK FOR VEHICLE SLIDING DOOR UPPER TRIM FRAMES

[76] Inventor: Lawrence J. Timmins, 18645 Matthews, Riverview, Mich. 48192

[21] Appl. No.: 763,857

[22] Filed: Sep. 23, 1991

[51] Int. Cl.[5] ..... B65D 85/68; B65D 81/10

[52] U.S. Cl. ..... 206/335; 206/448; 206/592; 206/593; 211/60.1

[58] Field of Search ..... 206/335, 448, 386, 589, 206/592, 593, 600, 526; 211/60.1

[56] References Cited

U.S. PATENT DOCUMENTS

| | | | |
|---|---|---|---|
| 2,758,727 | 8/1956 | Clingman | 206/592 |
| 2,807,356 | 9/1957 | Blum | 206/335 |
| 2,919,022 | 12/1959 | Lidgard | 206/448 |
| 3,147,860 | 9/1964 | Kean, Sr. et al. | 206/448 |
| 3,216,564 | 11/1965 | Wolfe et al. | 206/448 |
| 4,529,092 | 7/1985 | Swingley, Jr. | 206/593 |
| 5,004,102 | 4/1991 | Timmins et al. | 206/600 X |

*Primary Examiner*—Bryon P. Gehman

[57] ABSTRACT

A shipping rack is provided for storing and transporting vehicle sliding door upper trim frames which must be adequately supported to prevent movement thereof during shipment which movement could cause damage to finished surfaces. The vehicle sliding door upper trim frames include an elongated central portion having end portions extending therefrom. The shipping rack includes an elongated lower frame end portion receiver structure for receiving one of the frame end portions and an elongated upper frame end portion frame holder structure for holding the other end portion. This arrangement results in supporting vehicle sliding door upper trim frames without contact with each other and in such fashion as to prevent any substantial movement during shipment.

5 Claims, 3 Drawing Sheets

SHIPPING RACK FOR VEHICLE SLIDING DOOR UPPER TRIM FRAMES

BACKGROUND OF THE INVENTION

1. Field of the Invention:

This invention relates to a shipping rack for vehicle sliding door upper trim frames.

2. Prior Art:

In modern automotive manufacturing, it is common practice to assemble complete vehicles at a single location from various parts and components which are shipped to the assembly location from other locations. The parts and components are normally fabricated in facilities remote from the assembly location, packaged and then shipped to the assembly locations. The packaging frequently has involved the use of cardboard. This has caused a problem at the point of use. Cardboard creates a disposal problem. The disposal of such cardboard materials has engendered relatively high costs.

It is desired to use returnable racks and containers, particularly such as are constructed of plastic materials. Such units are relatively lightweight, while at the same time being sturdy and durable in use.

However, a problem has been encountered in connection with the shipment of vehicle sliding door upper trim frames. These frames are of the type mounted at the top of the sliding door opening for a vehicle such as a minivan. The frames are fabricated of plastic materials and have exterior finished surfaces, referred to as "class A" surfaces. These surfaces may be marred if abraded or impacted during shipment. A damaged surface frequently results in the necessity to reject the frame or, at the least, involves expensive repair procedures.

In accordance with the present invention, a reusable rack for transporting vehicle sliding door upper trim frames is provided. Major portions of the rack are fabricated of a plastic material which has relatively high strength. A suitable plastic is, for example, a high density polyethylene copolymer. The construction of the rack is adapted to prevent scratching, gouging or like damage to the frames during storage and transport. The rack of the present invention provides separation of the frames from each other and largely from other structure. The rack is re-usable and does not involve a disposal problem at assembly points. The re-usable nature of the rack results in ultimate lower costs. Further, the rack is collapsible, thereby permitting a reduction in volume when then rack is returned for further use.

SUMMARY OF THE INVENTION

A shipping rack is provided for vehicle sliding door upper trim frames. The frames are of the type fabricated of plastic material. The frames comprise an elongated central portion for positionment along the upper edge of a vehicle sliding door opening. An end portion extends from each end of the central portion and is substantially perpendicular with respect thereto. One of the end portions is shorter than the other end portion which is longer. The end portions are adapted to extend downwardly from the upper edge of the vehicle sliding door opening.

The shipping rack includes a base. A pair of oppositely disposed end walls are secured to the base. The base has a generally horizontal loading surface.

At least one elongated lower frame end portion receiver structure is provided on the horizontal loading surface of the base and extends between the end walls.

The lower frame end portion receiver structure includes first and second elongated receiver elements located in horizontal side-by-side relationship. Each receiver element has a plurality of spaced apart upwardly facing recesses therein. Each of the recesses is adapted to receive one of the shorter end portions of a frame. The first receiver element is positioned higher than the second receiver element.

At least one elongated upper frame end portion holder structure extends between the end walls and is secured thereto. Said elongated upper frame end portion holder structure being positioned above the lower frame end portion receiver structure and includes first and second elongated holder elements each having a plurality of spaced apart upwardly facing slots therein. The longer end portions of each frame each having a wall section. Each of said slots being adapted to receive a wall section of one of the longer end portions of a frame. The first holder element being positioned higher than the second holder element. The first and second receiver elements and the first and second holder elements are reversely positioned with respect to each other so that the frames are loaded into the shipping rack in oppositely facing relationship. The longer end portions of frames loaded in the first holder element being in horizontal overlapping relationship with respect to longer end portions of frames mounted in the second holder element. The first holder element being removably mounted to the side walls of the shipping rack to facilitate loading and unloading of frames on the second holder element.

The first and second holder elements are horizontally off-set with respect to each other to permit the side-by-side location of the receiver elements and avoid horizontal overlapping of the recesses therein. The second holder element is also removably mounted to the side walls of the shipping rack. The side walls of the shipping rack are removably mounted on the base whereby the shipping rack may be disassembled when empty for storage purposes.

Each of the first and second holder elements include an upwardly facing recess adjacent each slot. The longer end portions of the frames each having an enlarged wall portion adjacent the wall section. Each enlarged wall portion being received in the recess adjacent the slot in which the wall section of a longer end portion is received. The recesses of the receiver elements are larger than the shorter end portions of a frame to limit contact of the shorter end portions with the receiver elements.

DETAILED DESCRIPTION OF A PREFERRED EMBODIMENT

Figure 1:
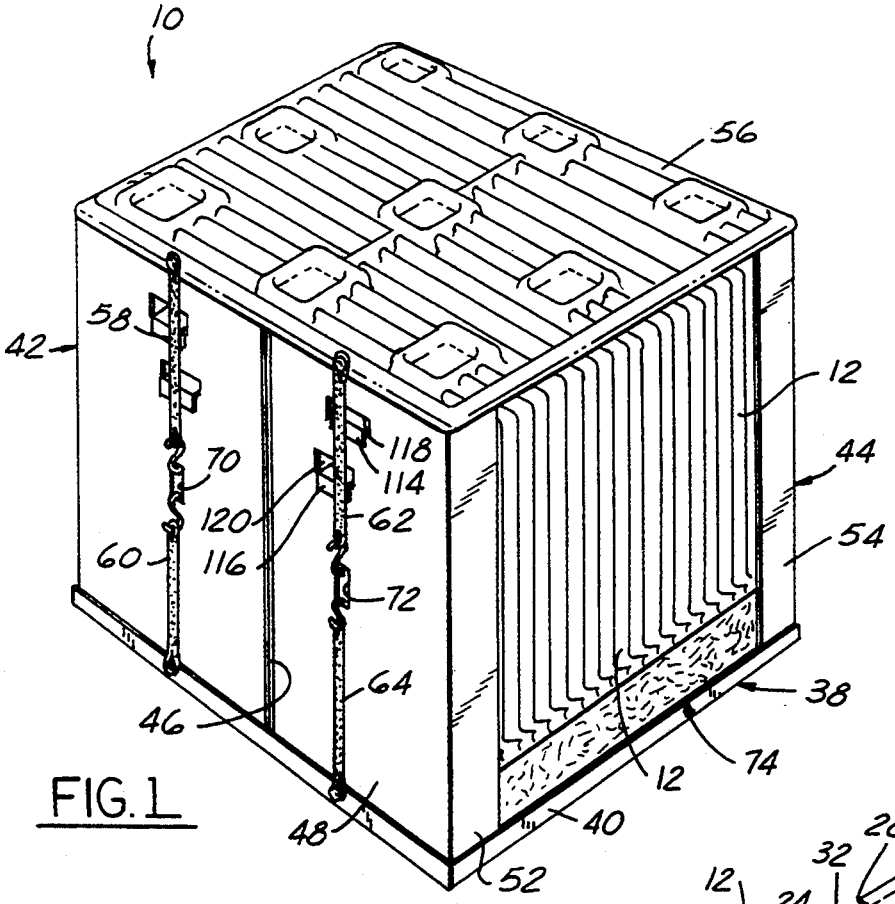
FIG. 1 is a view in perspective of the shipping rack for vehicle sliding door upper trim frames in accordance with one embodiment of the present invention, the rack being illustratively loaded with vehicle sliding door upper trim frames.
Figure 2:
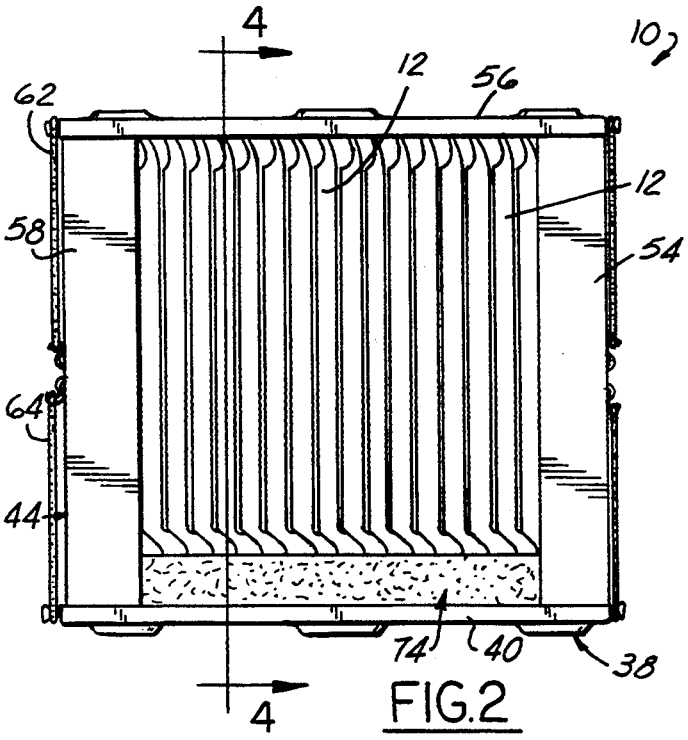
FIG. 2 is an end elevational view of the shipping rack of FIG. 1.

Referring to the drawings, it will be noted that the shipping rack 10 is designed to receive and support a plurality of vehicle sliding door upper trim frames 12. The frames 12 have a non-symmetrical shape that presents difficulties in providing a suitable support therefore. As previously discussed, the frames must be mounted in such a way as to be firmly in place while at the same time not subject to abrasion or impacting of the exterior surfaces 14 which are finished surfaces and will be observable when the frame is mounted in a vehicle.

Figure 3:
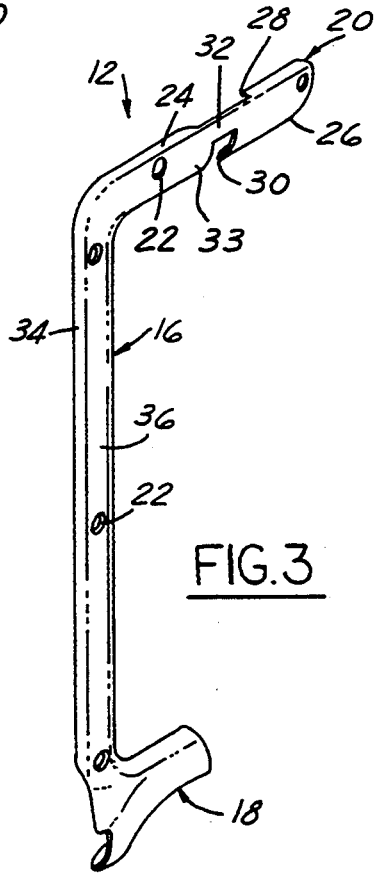
FIG. 3 is a view in perspective of a vehicle sliding door upper trim frame.

The basic shape of the frames 12 will first be described. The frames 12 are the type fabricated of plastic material and comprise an elongated central portion 16 for positionment along the upper edge of a vehicle sliding door opening. An end portion 18, 20 extends from each end of the central portion 16. The end portions 18, 20 are substantially perpendicular with respect to the central portion 16. One of the end portions 18 is shorter than the other end portion 20 which is longer as may be noted in FIG. 3. The end portions 18, 20 are adapted to extend downwardly from the upper edge of the vehicle sliding door opening. A plurality of openings 22 are provided in the central portion 16 and longer end portion 20 to receive fastening means to secure the frame 12 in place on a vehicle. The longer end portion 20 includes an outer wall portion 24 and an inner curved wall portion 26. A notch 28 is provided in the outer wall portion 24 and a second notch 30 is provided in the inner wall portion 26. The notch 30 defines a relatively narrow wall section 32, the segment 33 of inner wall portion 26 adjacent the wall section 32 being enlarged with respect thereto. The structure of the central portion 16 is substantially the same as the end portion 20, including an outer wall portion 34 from which extends a curved inner wall portion 36. The shorter end portion 18 is L-shaped in plan and is substantially U-shaped in cross section.

The shipping rack 10 includes a base 38 having a generally horizontal loading surface 39. An upstanding peripheral wall 40 is provided on the base 38 to retain in place the lower edge portions of a pair of hinged rack wall members 42, 44. The wall members 42, 44 are substantially the same and wall member 44 will be described. Wall member 44 includes an inner side wall 46, a pair of oppositely disposed end walls 48, 50, and a pair of outer side wall segments 52, 54. The segments 52, 54 define a large central side opening which facilitates access to the shipping rack interior for loading and unloading frames. The wall members 42, 44 may be erected or removed as needed. A lid 56 is received on the upper edges of the wall members 42, 44 after the shipping rack 10 is loaded with frames 12. When the shipping rack 10 is unloaded, the wall members 42, 44 may be collapsed to a much smaller volume for return to the manufacturing plant from which they originated. Two pairs of stretchable straps 58, 60 and 62, 64 are swivelly mounted on, respectively, the base 38 and lid 56. Each strap has a hook on the outer end thereof which is engagable with openings 70, 72 provided in the end walls to secure the entire shipping rack 10 together. Identical straps and openings are provided on the other side of the shipping rack 10.

Figure 9:
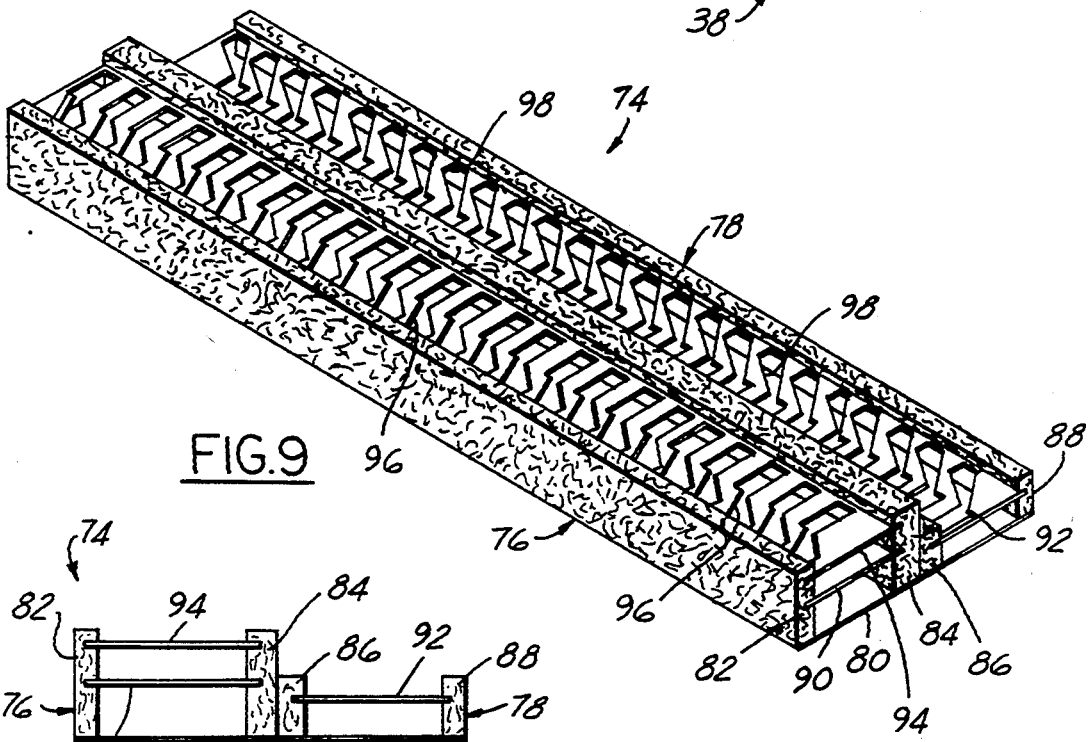
FIG. 9 is a view in perspective of the lower frame end portion receiver structure.
Figure 10:
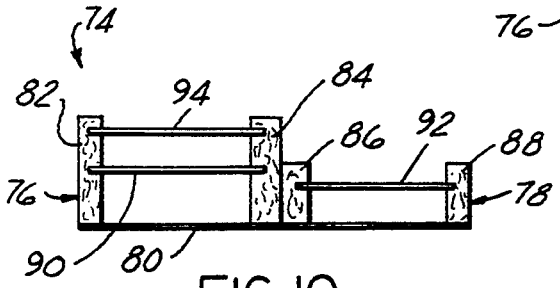
FIG. 10 is an end elevational view of the lower frame end portion receiver structure of FIG. 9.

Each of the hinged wall members 42, 44 is adapted to receive a set of frames 12 therewithin. The structure is the same for both wall members and only the structure for wall member 44 will be described. An elongated lower frame end portion receiver structure 74, illustrated in various of the figures and specifically shown in FIGS. 9 and 10, is provided on the loading surface 39 of the base 38. The structure 74 extends between the oppositely disposed end walls 48, 50. The lower frame end portion receiver structure 74 includes first and second elongated receiver elements 76, 78. The receiver elements 76, 78 are located in horizontal side-by-side relationship although the first receiver element 76 is taller than the second receiver element 78. This relationship permits the loading of two sets of frames 12 on the structure 74. The structure 74 includes a lower panel 80 from which extend upwardly two pairs of elongated spaced apart walls 82, 84 and 86, 88, the walls 82, 84 being taller than the walls 86, 88 as previously mentioned. A pair of elongated narrow panels 90, 92 are received in slots provided in the walls 82, 84 and 86, 88 above the panel 80 and an additional elongated narrow panel 94 is received in slots provided in the walls 82, 84 above the panel 90. The panels 92, 94 are each provided with a plurality of spaced apart openings 96, 98 along the length thereof which, in combination with the lower panels 80, 90, define recesses adapted to receive the shorter end portions 18 of frames 12. As will be noted in FIG. 9, the openings 96, 98 are L-shaped to conform to the shape of the end portions 18. The recesses thus defined by the panel structures result in recesses of the receiver element 76 being positioned higher than the recesses of receiver element 78. Preferably, the panels 80, 90, 92, 94 are fabricated of a solid plastic material while the wells 82, 84, 86, 88 are fabricated from a plastic foam material. It will be noted that the openings 96 are reversed with respect to the openings 98 so that frames 12 may be loaded into the shipping rack 10 in oppositely facing relationship to permit more compact loading of the shipping rack 10.

The openings 96, 98 are larger than the size of the shorter end portions 18 of a frame 12 to limit contact of the shorter end portions 18 with the receiver element structure. This tends to minimize any scratching or other abrasion which might occur if the openings were a tight fit.

Figure 6:
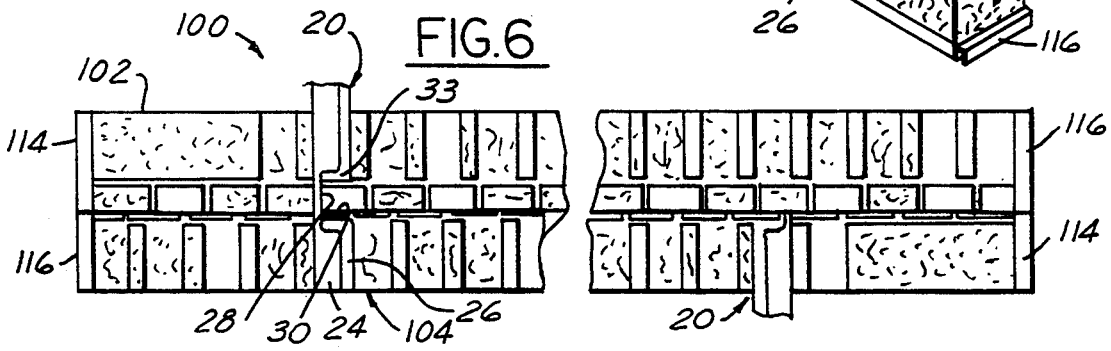
FIG. 6 is a top plan view of a holder element of FIG. 5.
Figure 7:
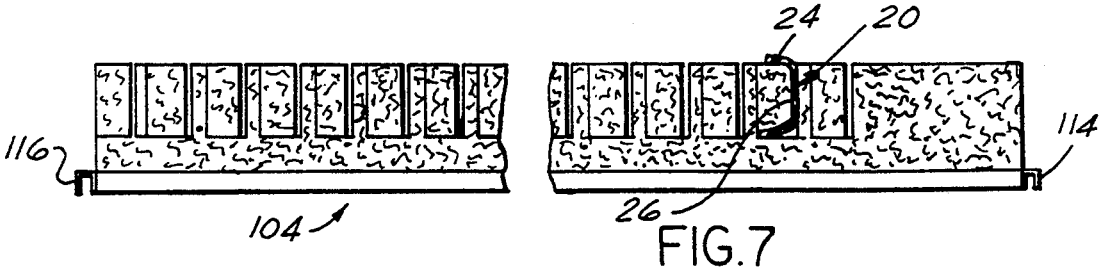
FIG. 7 is a front elevational view of the holder element of FIG. 5.
Figure 8:
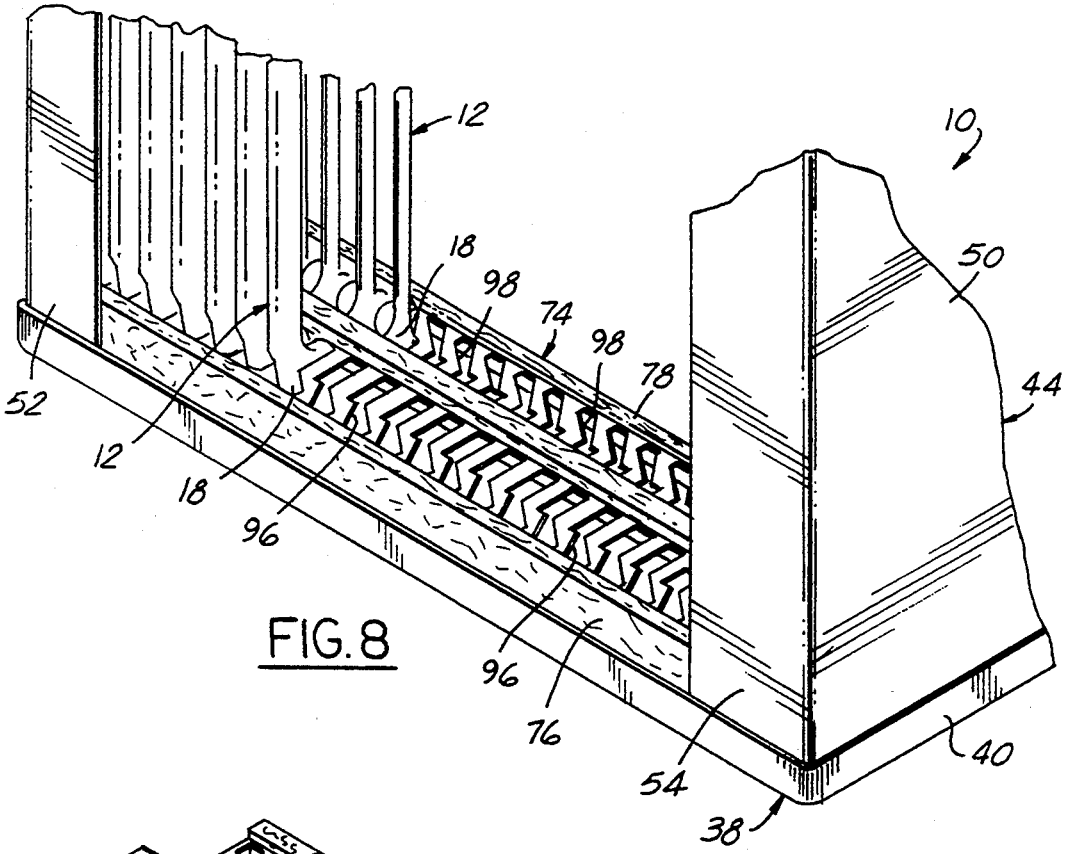
FIG. 8 is a view in perspective of the lower portion of the shipping rack of FIG. 1 with a portion of the vehicle sliding door upper trim frames removed to illustrate the structure of the lower frame end portion receiver structure.

An elongated upper frame end portion holder structure 100 extends between the end walls 48, 50 and is secured thereto. The structure 100 is positioned above the lower frame end portion holder structure 74. The structure 100 includes first and second elongated holder elements 102, 104, preferably fabricated of foam plastic and mounted on panels 103, 105. Each holder element 102, 104 has a plurality of spaced apart upwardly facing slots 106, 108 therein. The wall sections 32 defined by the notches 28 of the longer end portions 20 of frames 12 are received in the slots 106, 108 with the longer end portions 20 of frames 12 mounted in the holder element 102 facing oppositely to the longer end portions 20 of frames received in holder element 104. As will be noted in FIGS. 6 and 9, in order to achieve this result, the first and second receiver elements 76, 78 and the first and second holder elements 102, 104 are reversely positioned with respect to each other. The first and second holder elements 102, 104 each include an upwardly facing recess 110, 112 adjacent each slot 106, 108. The wall segment 33 (which is enlarged with respect to the wall section 32) of each wall portion 26 nests within the recesses 110, 112. This arrangement provides for firm seating of the end portions 20.

Figure 4:
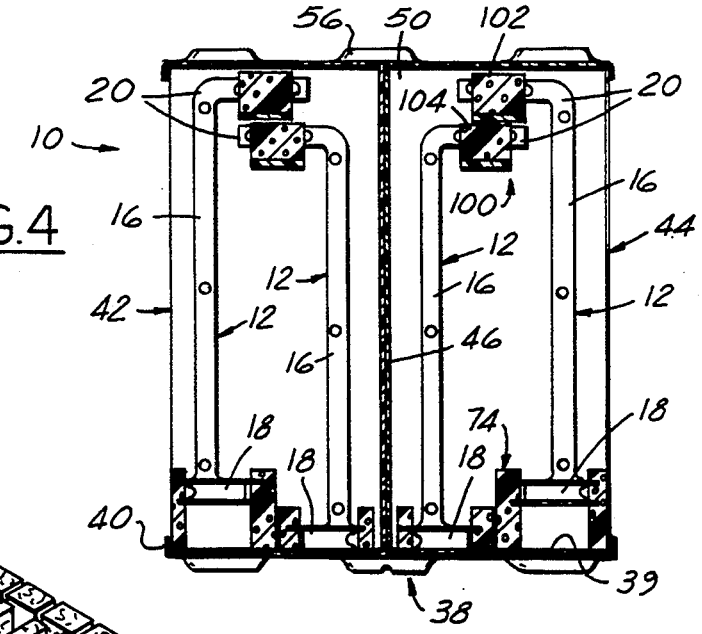
FIG. 4 is a sectional view taken substantially along the line 4—4 of FIG. 2 looking in the direction of the arrows.
Figure 5:
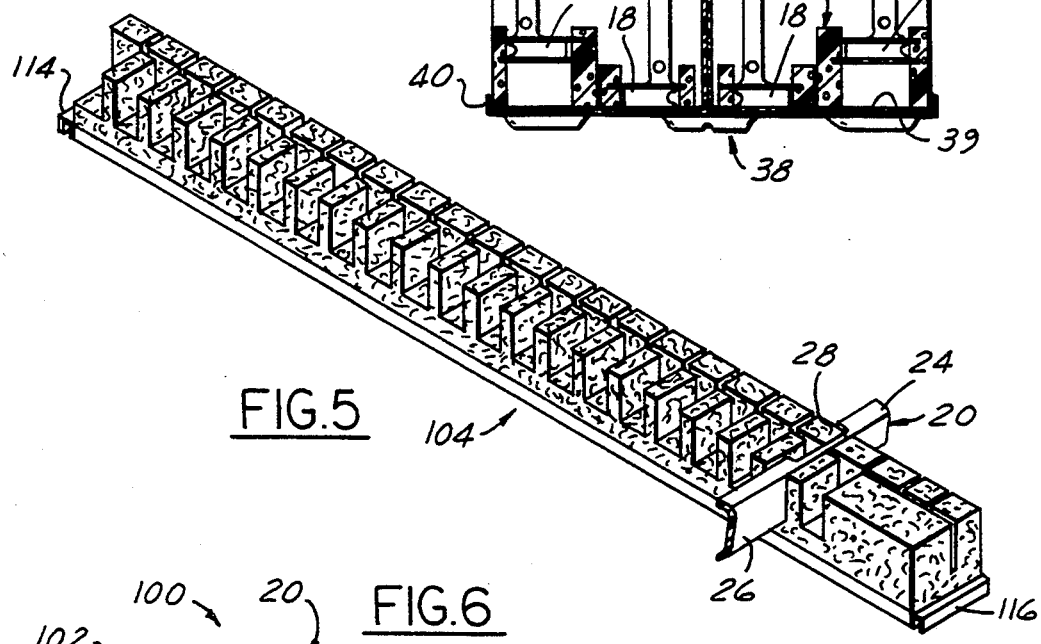
FIG. 5 is a view in perspective of a pair of holder elements forming an elongated upper frame end portion holder structure with an end portion of a sliding door upper trim frame illustratively in place.

As will be noted in FIG. 4, the first holder element 102 is positioned higher than the second holder element 104. This is consonant with the positionment of the first and second receiver elements 76, 78. With this arrangement, the longer end portions 20 of frames mounted in the first receiver element 76 and first holder element 102 are positioned above the end portions 20 mounted in the second receiver element 78 and second holder element 104. This arrangement permits longer end portions 20 of frames 12 loaded in the first holder element 102 to be in horizontally overlapping relationship with respect to longer end portions 20 of frames 12 mounted in the second holder element 104. This leads to compact loading of the shipping rack 10.

As will be noted in FIGS. 1 and 5–7, each of the holder elements 102, 104 is provided with a channel section 114, 116 at each end thereof. These channel sections are received in openings provided in end walls 48, 50. Referring to FIG. 1, it will be noted that openings 118, 120 re shown in end wall 48. Similar openings are provided in end wall 50 and the end walls of hinged wall member 42. The channel sections 114, 116 thus removably mount the holder elements to the end walls. This is of particular importance with respect to the first holder element 102 which may be easily removed to facilitate loading and unloading of frames 12 from the second holder element 104. Both holder elements may, of course, be removed to disassemble the shipping rack 10 when empty for storage purposes. The wall members 42, 44 may also be removed from the base 38 in the disassembly process.

Referring again to FIG. 1, it will be noted that the openings 118, 120 are horizontally offset. This results in the first and second holder elements 102, 104 being offset with respect to each other when mounted on the end walls 48, 50. This arrangement permits the side-by-side location of the receiver elements 76, 78 and avoids horizontal overlapping of the recesses therein as previously described.

I claim:

1. A shipping rack for vehicle sliding door upper trim frames, the frames being of the type fabricated of plastic material and comprising an elongated central portion for positionment along the upper edge of a vehicle sliding door opening, an end portion extending from each end of the central portion and being substantially perpendicular with respect thereto, one of the end portions being shorter than the other end portion which is longer, the end portions adapted to extend downwardly from the upper edge of the vehicle sliding door opening, the shipping rack including: a base, a pair of oppositely disposed end walls secured to the base, the base having a generally horizontal loading surface, at least one elongated lower frame end portion receiver structure on the horizontal loading surface of the base extending between the end walls, each said lower frame end portion receiver structure including a first and a second elongated receiver element located in horizontal side-by-side relationship with respect to each other, each receiver element having a plurality of spaced apart upwardly facing recesses therein, each of said recesses being adapted to receive one of the shorter end portions of a frame, the first receiver element being positioned higher than the second receiver element, at least one elongated upper frame end portion holder structure extending between said end walls and secured thereto, each said elongated upper frame end portion holder structure being positioned above a said lower frame end portion receiver structure and including a first and a second elongated holder element each having a plurality of spaced apart upwardly facing slots therein, the longer end portions of a said frame each having a wall section, each of said slots being adapted to receive a wall section of one of said longer end portions of a frame, the first holder element being positioned higher than the second holder element, the first and second receiver elements and the first and second holder elements being positioned with respect to each other in a manner such that frames may be loaded into the shipping rack in oppositely facing relationship with the longer end portions of frames loaded in the first holder element being in horizontal overlapping relationship with respect to longer end portions of frames mounted in the second holder element, the first holder element being removably mounted to the side walls of the shipping rack to facilitate loading and unloading of frames from the second holder element.

2. A shipping rack as set forth in claim 1, wherein the first and second holder elements are horizontally offset with respect to each other to permit the side-by-side location of the receiver elements and avoid horizontal overlapping of the recesses therein.

3. A shipping rack as set forth in claim 1, wherein the second holder element is removably mounted to the side walls of the shipping rack, the end walls of the shipping rack being removably mounted in the base whereby the shipping rack may be disassembled when empty for storage purposes.

4. A shipping rack as set forth in claim 1, wherein each of the first and second holder elements include an upwardly facing recess adjacent each slot, the longer end portions of each said frame each having an enlarged wall segment adjacent said wall section, each enlarged wall segment being receivable in the recess adjacent the slot in which said wall section of a longer end portion of each said frame is receivable.

5. A shipping rack as set forth in claim 1, wherein the recesses of the receiver elements are larger than the shorter end portions of a frame to limit contact of the shorter end portions of a frame with the receiver elements.

* * * * *